United States Patent [19]

Messerschmitt

[11] 4,334,448

[45] Jun. 15, 1982

[54] DEVICE FOR SHARPENING AND/OR FORMING THE PROFILE OF A SCREEN PRINTING SQUEEGEE

[76] Inventor: Elmar Messerschmitt, Paul-Hösch-Strasse 13, 8000 München 60, Fed. Rep. of Germany

[21] Appl. No.: 79,350

[22] Filed: Sep. 27, 1979

[30] Foreign Application Priority Data

Oct. 7, 1978 [DE] Fed. Rep. of Germany ..... 2843904

[51] Int. Cl.[3] ..... B26D 7/10; B26F 3/12

[52] U.S. Cl. ..... 83/171; 83/16; 83/455; 83/613

[58] Field of Search ..... 83/171, 454, 455, 451, 83/452, 614, 613, 640, 648, 16

[56] References Cited

U.S. PATENT DOCUMENTS

| | | | |
|---|---|---|---|
| 3,352,011 | 11/1967 | Alexander et al. | 83/171 X |
| 3,693,253 | 9/1972 | Jäger et al. | 83/171 X |
| 3,978,749 | 9/1976 | Polenz | 83/171 X |
| 4,017,012 | 4/1977 | Brock | 83/171 X |

*Primary Examiner*—Donald R. Schran
*Attorney, Agent, or Firm*—Wm. R. Price

[57] ABSTRACT

The device for sharpening and/or forming the profile of a silk screen printing squeegee consists of clamping means for firmly holding squeegee strips 12 without deformation and of a tool movable along the clamped squeegee strip 12 relative to the latter, which is designed as a heated cutting tool 6, namely as a wire or knife.

7 Claims, 15 Drawing Figures

DEVICE FOR SHARPENING AND/OR FORMING THE PROFILE OF A SCREEN PRINTING SQUEEGEE

FIELD OF THE INVENTION

The invention concerns a device for sharpening and/or forming the profile of a silk screen printing squeegee with a clamping means for the squeegee, and a tool moving along the clamped squeegee relative to the latter.

BACKGROUND OF THE INVENTION

This invention relates to what is commonly known as silk screen printing. While the term silk screen printing is widely used, materials other than silk may be used to form the screen. For silk screen printing a wood or metal screen frame is needed over which the screen material is stretched. The art work may be produced on the silk screen in a number of different ways. Thus, for example, the art work may be placed on the screen by using oily paint, lithographic crayon or other oil base drawing ink as the screen is stretched tightly in the frame. Primarily, however, the art work is produced with a hydrophobic material. After drying, the art work which is positive, is run over with a water soluble glue or size. This shuts up the mesh holes of the screen material outside of the hydrophobic oil like grease or grease like material. As a consequence, the art work itself does not become coated at these points on the screen materials. After drying of the glue, the oil base coloring material or paint is washed out with gasoline or turpentine so that at these points, the ink will be let through. The frame has to be large enough so that at the edge there is still enough space for the printing ink and for the squeegee. The squeegee is normally made of a handle with a broad cross runner made of wood with a strong rubber strip mounted in it. The mounted rubber strip has been generally trued up by plane grinding. The paper is placed on the screen printing table under the screen and may in some cases be kept in position by a vacuum system. The screen with the art work is then put into position, a thick layer of printing ink is put onto one end of it. The squeegee is then pulled over the screen towards its other end while evenly pushing it against the screen so that a certain amount of ink is forced through the open mesh holes onto the paper. In this way, a great different variety of materials can be printed as for example, metal, wood or glass. The art work may further take the form of paper or film stencils which are adhesively joined to the screen materials. As will be appreciated the strong and solid plane of the machined rubber strip has the purpose of evenly inking or printing and evenly forcing the printing ink through the mesh of the screen material. Therefore, the crucial part of the invention is that the rubber strip of the squeegee is produced with the highest possible degree of exactness in the length-direction and rests completely flatly in its working position on the screen. Furthermore, if the material to be screened is of a material other than flat and planar, it is necessary to make the screen and the squeegee so that its profile follows the contour of the surface to be printed. Thus, for example, if the surface to be printed is convex, it is necessary to use a concave screen material and a concave squeegee.

Squeegee strips consist normally in screen printing of rubber or an elastic plastic. They must be so designed that their edge act directly on the ink in suitable form (blade angle) and brings the screen in proper contact with the surface of the material to be printed, and not only presses the ink into the screen during its movement, but also removes it evenly from the surface of the screen. This requires not only a correct thickness and elasticity of the squeegee strip, but also a suitable design of the profile.

DESCRIPTION OF THE PRIOR ART

This profile form was heretofore produced by means of grinding machines of various types. Silk screen printing squeegee grinding machines work on the known principles of grinding with grinding belt or grinding disk. Due to the pressure required for grinding, the squeegee strip is deformed. For this reason the grinding surface has mostly a different form in the unloaded state (hollow grinding) etc.) than during grinding. The grinding tools also produce a certain roughness, which frequently cause hardly visible differences in coloration. Toward the end of the squeegee strip, the latter yields under pressure, causing level differences. The grinding of round profiles, but also of a certain blade angle can not be carried out in practice accurately and evenly over the entire length, even with complicated guides.

Though squeegee strips are cut occasionally in high-speed cutters with the long knife to be surface-ground later, this is difficult with squeegee strips, which are clamped in a squeegee holder, apart from the fact that concave cutting surfaces are obtained.

It is also known to cut elastomeric material with electrically heated cutting tools. See e.g. Germ. Pat. No. 1,943,189. Screen printing squeegees can not be worked with such a cutting tool, particularly because the squeegee can not be clamped properly, and the cutting tool can not be guided properly along the squeegee.

SUMMARY OF THE INVENTION

The invention is based on the problem of providing a device for sharpening and/or forming the profile of a screen printing squeegee, which is characterized by a high working precision of the squeegee produced with it. The device is to be simple in design and permit the production of the squeegee at sufficient speed despite high precision.

For the solution of this problem, the invention is characterized in that the tool is designed as a heated cutting tool, namely a wire or knife. Particularly a heated knife will be used for the device, because the knife can be profiled according to the desired contour and has a longer tool life and provides greater possibilities of application than a wire. In simple cases, however, a heated wire can also be used. Surprisingly it was found that the above-described disadvantages of the known device do not appear in the new device.

The setting of the proper cutting temperature has the effect that the resistance of the elastomer against the cutting is so low that the desired form of the profile is achieved evenly with great precision over the entire length of the strip by the form and the angle of the knife respectively, without the edges becoming unsharp or the faces rough. The temperature control prevents not only excessive heat, which could cause melting, but also wear of the knife by overheating, e.g. outside the cutting zone.

Cutting temperature and cutting speed are to a certain degree interdependent, for this reason the possibility of controlling the temperature and keeping the speed constant, if necessary, is important for a proper cut.

Good results can be obtained at a speed of v=200 to 500 mm/min. and a temperature of 300 to 500 deg. C. depending on the type of the squeegee strip.

In thermoplastic elastomers, such as Vulkollan, the suggested sharpening device even permits regrinding without cutting, namely by smoothing with the heated knife, inclined, in contrast to cutting.

Preferred embodiments of the subject of the invention will result from the subclaims. If a thermometer probe is arranged on the cutting tool, the latter can ensure the necessary constancy of the operating temperature of the cutting tool.

The constancy of the operating temperature depends on the type of the squeegee strip. For less sensitive squeegee strips, stabilization of the power line instead of temperature control is sufficient.

Preferably the cutting tool itself is designed as an ohmic resistance to generate the required heat. But it is also possible to provide on the cutting tool a heating wire or any other heating elements or heating medium for the cutting tool. For example, a heating wire can extend along the cutting edge of the knife.

If the cutting tool is designed as a knife, whose blade angle is adjustable, the various desired profiles can be produced with it.

It is also preferred if the cutting tool is clamped resiliently in its holder transverse to the cutting direction. The knife is shaped or clamped according to the desired profile form. This resilient adjustment has among others the function of absorbing longitudinal expansions of the tool.

It serves the same purpose if the working height of the cutting tool is relatively adjustable. A coarse-and fine adjustment is preferred.

It is also important that the knife can be clamped in its holder in normal cutting position and in reverse position. In this reverse position, the knife thus works on the previously cut edge with its back and thus smoothes the edge.

If at least one adjustable stop is provided on the receiver for the squeegee, the working length can be adjusted.

It is important that the squeegee is not brought out of its starting position during working. To this end it is preferred if the squeegee can be clamped at the end which is not to be worked, as well as in the range of its end to be worked. The clamping, possible close to the side of the squeegee strip to be worked, can be effected on the machine itself or be connected with the cutting carriage. It must be so designed and adjusted so that it straightens the squeegee strip, but does not squeeze it. If it is secured on the cutting carriage, it can consist of guide rollers, for example. If it is secured on the machine, it can consist of holding bars.

It is also preferred if a feeler is provided on the holder of the cutting tool toward the squeegee is stopped when the feeler strikes against a noncuttable obstacle or when the squeegee strip would otherwise be cut outside the provided zone. This feeler can also be used for the rapid adjustment of the cutting height, so that the erosion of the squeegee strip can be minimized.

BRIEF DESCRIPTION OF THE DRAWING

The invention will be described below on the basis of embodiments from which additional important features will result.

DETAILED DESCRIPTION OF THE INVENTION

Figure 1:
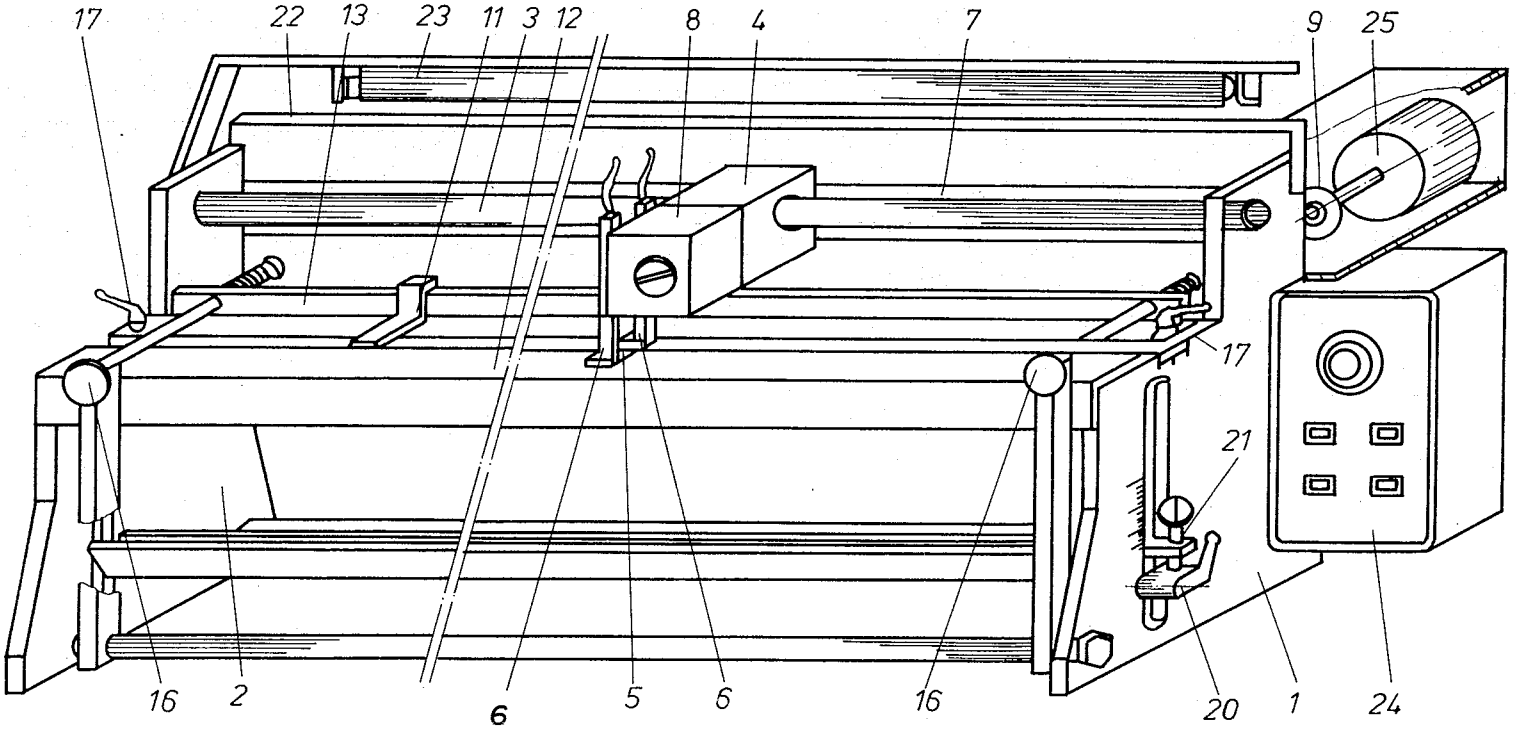
FIG. 1 shows a perspective general view of the new device.
Figure 4:
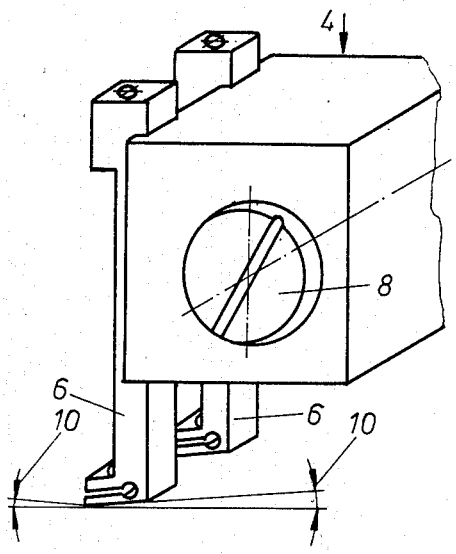
FIG. 4 shows a means for the angular adjustment of the cutting knife.
Figure 5:
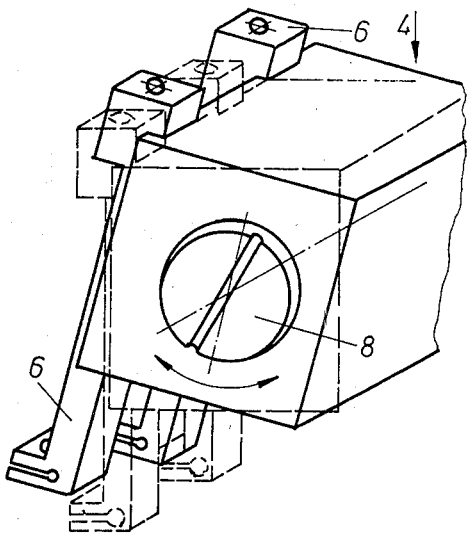
FIG. 5 shows the lifting of the holder according to FIG. 4 for the return of the guide carriage for the cutting tool.

First we will describe the principal design of the new device on the basis of FIG. 1. The device has a frame with jaws 1,2 which are joined with each other over suitable traverses. On a guide rail 3 provided between the jaws 1,2 is displaceably mounted on a carriage 4, which carries a heated cutting tool, preferably a heated knife 5, clamped between holders 6. The guide for the knife consists of guide rail 3 with carriage 4, which is guided by another guide rail 7. This guide rail can also be designed as a cam. Furthermore an angle adjustment 8 is provided for holder 6 and a drive 9 for slidable carriage 4. Angular adjustment 8 adjusts the proper blade angle 10 (see FIG. 4) of knife 5. It also serves to lift the holder during its return into the starting position, as shown in FIG. 5.

In addition, a displaceable counter-pressure piece 11 for a squeegee strip 12 is provided, which can be displaced along the squeegee strip. The counter-pressure piece serves as a stop. The counter-pressure piece can also cooperate with a limit switch to control the feed.

Figure 2:
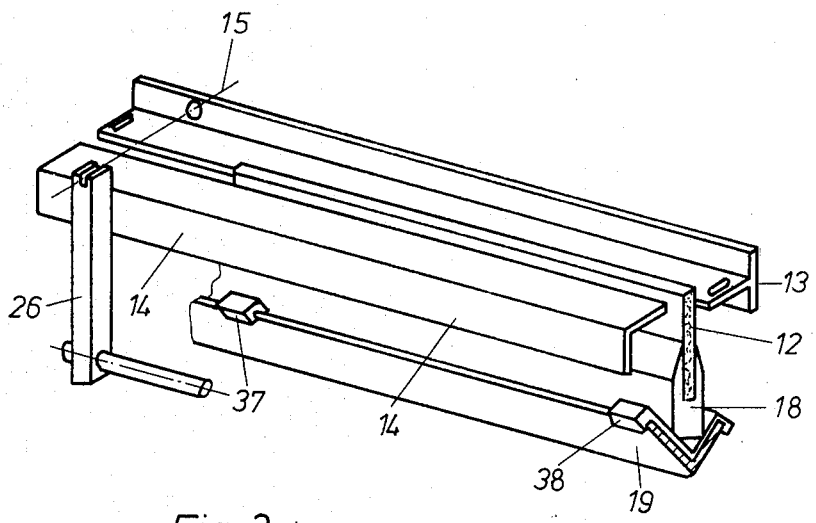
FIG. 2 shows a detail of the device according to FIG. 1, namely the holder of the squeegee strip.

An adjustable rear lateral holding bar 13 cooperates with a front lateral holding bar 14 (see FIG. 2). Both holding bars clamp squeegee strip 12 between them and can be turned upward about an axis 15. The front lateral holding bars can also be displaced parallel to themselves, if necessary. The front lateral holding bar 14 is so adjustable that it just straightens the squeegee strip without squeezing it.

The rear lateral holding bar 13 can be brought close to squeegee strip 12 by means 17 or be removed from it. The squeegee strip is arranged in a receiver 18 which in turn is mounted in a V-shaped receiver 19.

Figure 3:
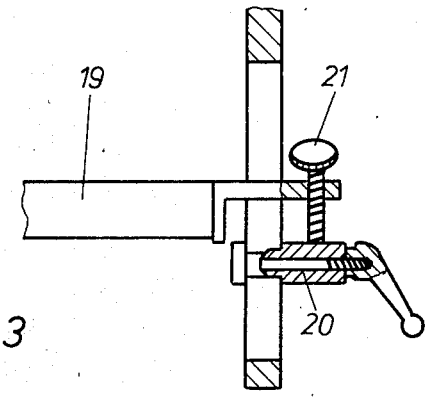
FIG. 3 shows a partial sectional view of a means for the vertical adjustment of the squeegee strip in this device.

Squeegee receiver 18, 19 can be adjusted in its working height to knife 5 by means of a vertical adjustment 20. A fine adjustment 21 is provided for this purpose (see also FIG. 3).

The device also has a control bar 22 for checking the squeegee profile, a lamp 23 for a light gap test, a switch box 24 for controlling the heating current, a motor 25 for drive 9 and an axle 26 for the front holding bar 14; FIG. 4 shows the adjustment for straight cutting with a blade angle between 0 and 2 deg. for example. FIG. 5 shows the lifting of holder 6 for the return of carriage 4, to avoid contact with the squeegee.

Figure 6:
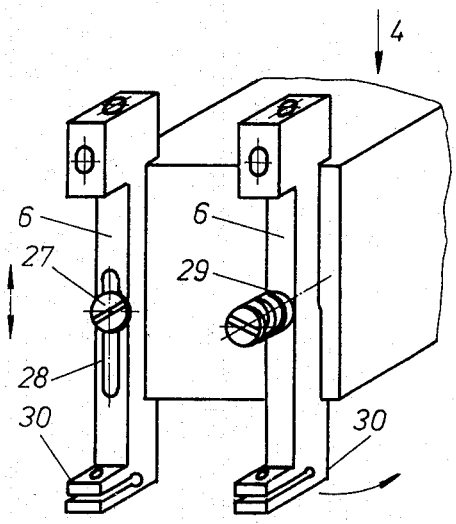
FIG. 6 shows a likewise perspective view of the holder with a carriage to illustrate additional details.

FIG. 6 shows holder 6, on the left vertically adjustable over screw 27 with oblong slot 28, and on the right biased against a spring 29. Knife 5 is clamped between clamping jaw 30 of holder 6.

Figure 7:
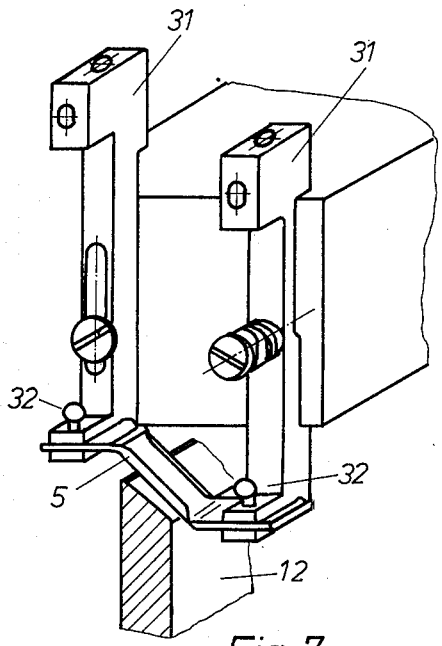
FIG. 7 shows a view corresponding to FIG. 6 with other details.

FIG. 7 shows additionally terminals 31 for the holder, clamping means 32 for the knife, as well as an inclined knife 5.

Figure 8:
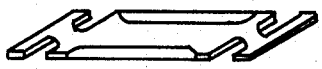
FIGS. 8–11 show perspective views of different embodiments of a cutting knife.
Figure 9:
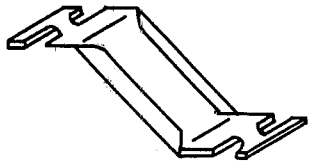
Figure 10:
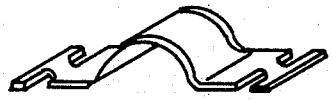
Figure 11:
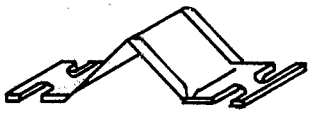

FIGS. 8–11 show differently profiled knives 5, namely a straight knife (FIG. 8), the inclined knife according to FIG. 9, (FIG. 9) a round knife (FIG. 10) and a V-knife (FIG. 11).

Figure 12:
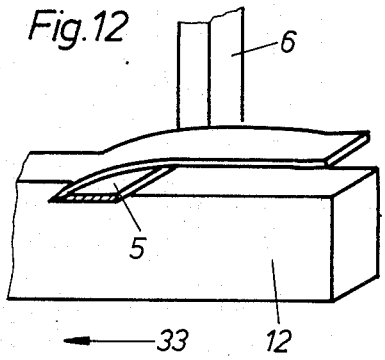
FIG. 12 shows the cutting knife according to FIG. 8 during cutting.

FIG. 12 shows as an example the cutting operation with a straight knife according to FIG. 8. With the squeegee strip 12 standing still, the knife is moved here in the direction of arrow 33. Instead, squeegee strip 12 could be moved and the knife standing still.

Figure 13:
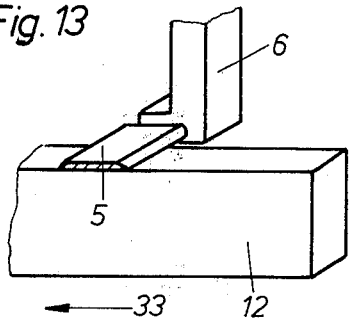
FIG. 13 shows the cutting knife according to FIG. 12 during the subsequent smoothing.

FIG. 13 shows the smoothing operation with the same knife according to FIG. 12, which is only turned around and clamped in holder 6. The knife could also be rounded with its rear edge.

Figure 14:
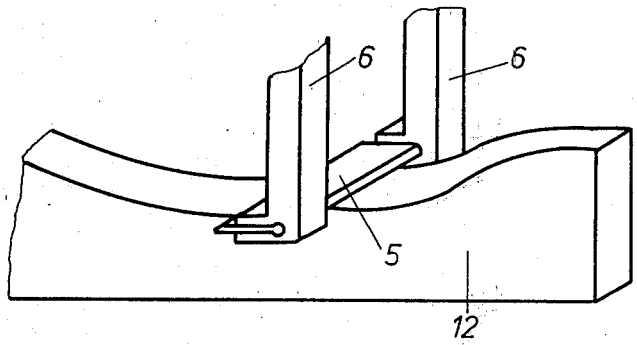
FIG. 14 shows the duplicating cutting of a squeegee contour with a straight knife.

FIG. 14 shows the duplicating cutting of a squeegee contour with the straight knife according to FIG. 8.

Figure 15:
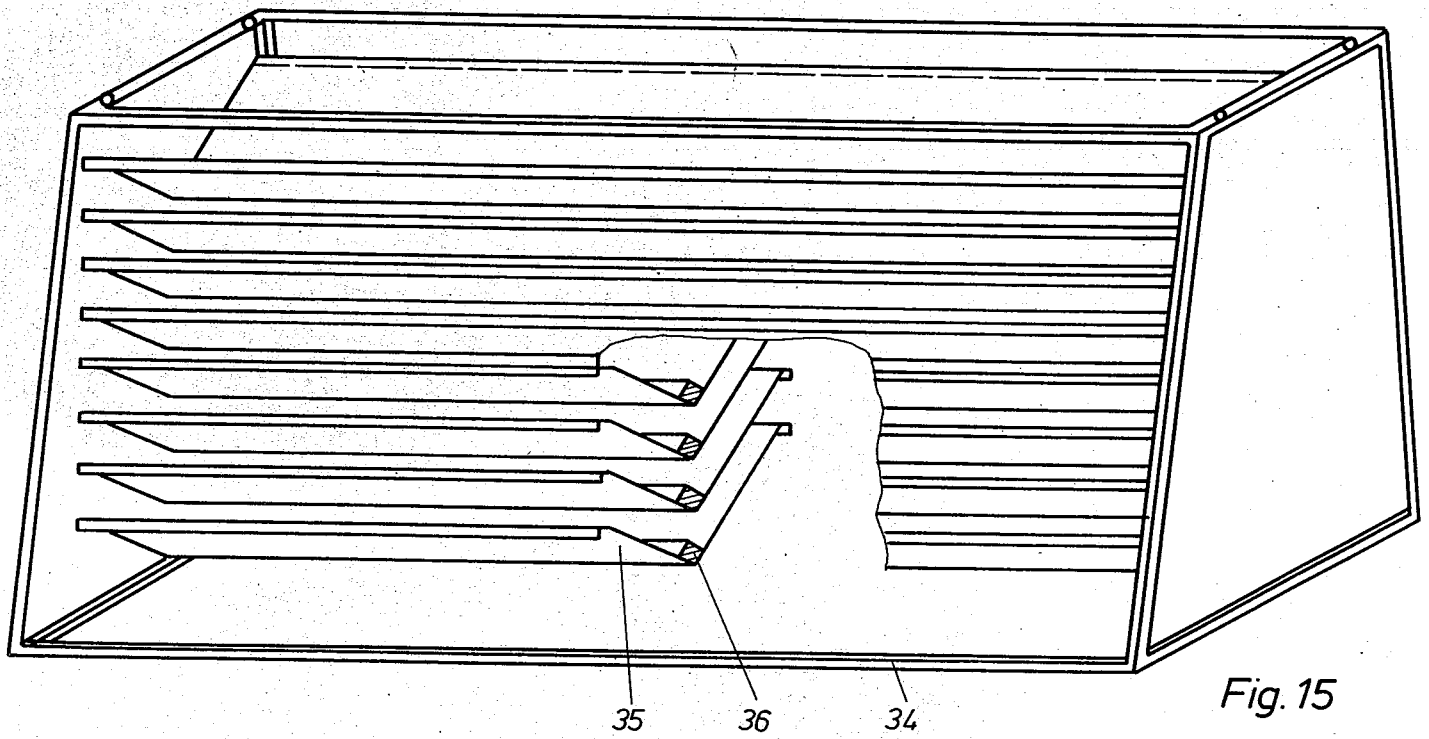
FIG. 15 shows a perspective view of an underframe of the device for storing squeegees.

FIG. 15 shows an underframe for the proper storage of squeegees, whose contour can be checked by means of control bar 22 or over the illuminating strip. The above mentioned underframe 34 has shelves 35 for the squeegee, which can be charged from both sides. On it are arranged elastic supports 36 of foam, e.g. to protect the edges of the squeegee strips.

The elastic squeegee strip 12 must neither be deformed nor curved upward, so that the cut drops somewhat toward the end of the squeegee, that is the squeegee strip can remain straight in the relaxed state or drop, but it must not stand up.

The squeegee strip is curved upward at its end by a counter-pressure piece 11, which can be adjusted slightly inclined from the bottom to the top.

In FIG. 2 two slides 37, 38 are provided in squeegee receiver 10, so that receiver 18 rests only on two points and can not seesaw.

The blade angle for the smoothing operation according to FIG. 13 is between about 0.3 and 1.5 degrees. The blade angle for cutting according to FIGS. 4 and 12 is primarily between 0.5 and 2.5 degrees.

The following advantages can be achieved with the new device.

Shaped knives always produce the same cut and require no reclamping of the squeegee; there is no dust; the working time can be reduced; a defined height of the squeegee blade can be produced and with the same blade angle and the same squeegee material, the same printing behavior can be reproduced. Form grinding where—simular as in duplicating cutting—the desired curved form could be transmitted for cutting over a diagraph system directly from the object or a template, if necessary, e.g. an edge of the squeegee receiver 18.

The advantage also consists in that an exactly identical squeegee edge form can be reproduced by correspondingly shaped knives and identical clamping of the squeegee, which is not possible in grinding with conventional tools, or can only be achieved with approximately good results at very high costs.

The movement of the knife can be effected by hand or by motor, the latter yielding the best results.

Instead of the represented knife form could also be used a heated wire.

What is claimed is:

1. A device for forming the profile of a silk screen printing squeegee which includes:

A. clamping means for resiliently holding the squeegee without deformation, which comprises:

1. a receiving member having a longitudinally disposed groove for grasping the edge of a squeegee which is not to be worked.
2. a vertically adjustable mounting means for supporting said receiving member and the squeegee carried thereby so that the working height of the edge of the squeegee to be worked can be vertically adjusted.
3. a front and rear lateral holding bar for firm but non-deforming engagement of said squeegee along its long axis and near the surface of the edge to be worked and along the cutting direction;

B. a heated cutting tool movable in a set horizontal plane along the long axis of said clamped squeegee.

2. Device according to claim 1, characterized in that the cutting tool is designed as an ohmic resistance in an electrical line.

3. Device according to claim 1, characterized in that, when the cutting tool is designed as a knife, its blade angle is adjustable.

4. Device according to claim 1, the further combination of:

A. a guiderail 7 extending along the long axis of said device, and;

B. a carriage 4, slidably mounted thereon for linear movement along said rail, said carriage including:

1. vertically extending holders having clamping means 30 for clamping the cutting tool in its holders transverse to the cutting direction.

5. Device according to claim 4 in which said vertically extending holders contain oblong slots 28, so that the working height of the cutting tool (5) is adjustable.

6. Device according to claim 1 the combination therewith of a counter-pressure piece 11, mounted transversely across said squeegee so that the squeegee (12) can be clamped at the end not to be worked and/or in the range of its end to be worked.

7. Device according to claim 5, in which the vertically extended slots 28 of said holder are mounted to said carriage near the top on one side and near the bottom on the other side and in which an inclined knife (FIG. 9) is clamped transversely to the clamping means 30.

* * * * *